US006751830B2

(12) United States Patent
Sternlieb et al.

(10) Patent No.: US 6,751,830 B2
(45) Date of Patent: Jun. 22, 2004

(54) METHOD OF HYDROENHANCING FABRICS USING A SHAPED ORIFICE

(75) Inventors: Herschel Sternlieb, Brunswick, ME (US); Paul F. Zolin, Kennebunk, ME (US)

(73) Assignee: Textile Enhancements International, Inc., Brunswick, ME (US)

( * ) Notice: Subject to any disclaimer, the term of this patent is extended or adjusted under 35 U.S.C. 154(b) by 0 days.

(21) Appl. No.: 10/706,261

(22) Filed: Nov. 12, 2003

(65) Prior Publication Data

US 2004/0093703 A1 May 20, 2004

Related U.S. Application Data

(62) Division of application No. 09/902,050, filed on Jul. 10, 2001, now Pat. No. 6,694,581.

(51) Int. Cl.[7] ..... D06B 1/02
(52) U.S. Cl. ..... 28/104; 28/167
(58) Field of Search ..... 28/104, 167, 105, 28/106, 163; 68/200, 201, 205 R; 239/1, 553.3, 553.5, 568, 548, 556, 560, 561, 597, 598, 599

(56) References Cited

U.S. PATENT DOCUMENTS 3,186,644 A * 6/1965 Ross et al. ..... 239/533.13
3,403,862 A * 10/1968 Dworjanyn ..... 239/566
4,069,563 A * 1/1978 Contractor et al. ..... 28/105
4,085,485 A * 4/1978 Brandon et al. ..... 28/104
4,152,480 A * 5/1979 Adachi et al. ..... 28/104
4,193,552 A * 3/1980 Ishikawa ..... 239/533.13
4,948,295 A * 8/1990 Pramsoler ..... 405/44
5,692,278 A * 12/1997 Fleissner ..... 28/105
5,806,155 A * 9/1998 Malaney et al. ..... 28/167
5,933,931 A * 8/1999 Greenway ..... 28/167
6,253,429 B1 * 7/2001 Zolin ..... 28/104
6,442,810 B2 * 9/2002 Greenway et al. ..... 28/104
6,571,441 B1 * 6/2003 Kobayashi et al. ..... 28/104
2002/0078538 A1 * 6/2002 Ngai ..... 28/104
2002/0116801 A1 * 8/2002 Oathout et al. ..... 28/104

* cited by examiner

*Primary Examiner*—Amy B. Vanatta
(74) *Attorney, Agent, or Firm*—Charles F. Seyboldt

(57) ABSTRACT

An apparatus and method for hydroenhancing fabrics is described. The method uses the force of pressurized liquid passing through elongated orifices and impinging on the fabric. The pressurized liquid exits in a coherent or columnar fashion from elongated orifices that are generally rectangular or linear in shape. The elongated orifices can be arranged so as to produce various effects on a web of fabric, including striping, graduated shading and seer-suckering. The elongated orifices also facilitate the hydroenhancement of high-warp-count fabrics without streak or moire effects. Liquid filtration can be relaxed without clogging the orifices, because the elongated orifices permit larger solid objects to pass. The use of elongated orifices also enhances the energy efficiency of the hydroenhancement process.

20 Claims, 4 Drawing Sheets

METHOD OF HYDROENHANCING FABRICS USING A SHAPED ORIFICE

CROSS REFERENCE TO RELATED APPLICATIONS

This application is a divisional of application Ser. No. 09/902,050, filed Jul. 10, 2001 now U.S. Pat. No. 6,694,581.

BACKGROUND OF THE PRESENT INVENTION

SUMMARY OF THE PRIOR ART

This invention relates to a method for hydroenhancing fabrics, and more particularly to a method for hydroenhancing fabrics using a shaped orifice wherein a liquid under pressure is forced through a non-circular orifice in a coherent jet and impinges onto a fabric. Multiple orifices are typically used, and the shape and orientation of the orifices (e.g. the distance between adjacent orifices, the angle between the major axes of the orifices and the direction of fabric travel and the direction of impingement) can be modified to effect different hydroenhancement properties. The method of hydroenhancement can be practiced using a variety of machinery configurations. One use for the method of the present invention is to impart "striping," i.e. a selective color wash-out to produce a pattern of alternating lighter and darker stripes across the width, and running the length of a fabric web.

The impingement of a liquid under pressure onto a fabric (hydroenhancement) to modify the properties of fabric materials is well known.

U.S. Pat. No. 3,560,326, Australian Patent 287,821 and Canadian Patent 739,652 to J. Bunting, U.S. Pat. Nos. 4,957,456 and 5,737,813 to Sternlieb, U.S. Pat. Nos. 5,791,028 and 6,253,429 to Zolin, and various other disclosures describe the use of pressurized liquid, usually water, exiting a manifold through an arrangement of circular orifices arranged either in a single line or in a pattern on an orifice strip; either impinging on a bat of loose fibers to make a non-woven fabric, or impinging on a fabric to change its properties.

U.S. Pat. No. 4,152,480 to Adachi, U.S. Pat. No. 4,085,486 to Brandon, and U.S. Pat. No. 3,906,130 to Tsurumi disclose the use of a single slot having a length that is equal to or greater than the width of the web of cloth being treated. In these references, the slot is arranged so as to cover the entire width of a cloth web, and the pressure of the liquid is limited due to the bending and deformation of the slot opening induced by the force of liquid pressure operating over a long unsupported length. This technology is useful for hydro-entanglement, i.e. the process of making a fabric from a loose bat of non-interwoven loose fibers, but the energy available at the maximum pressure is not adequate to appreciably alter the appearance or properties of a pre-existing fabric.

U.S. Pat. No. 4,960,630 to Greenway describes the use of a fan "jet" array. A fan "jet" has an elongated opening, usually appearing as a sector of a circle, that produces a fan-shaped spray. In the fan-shaped spray, the liquid emerges from the opening in various directions, i.e. the fan-shaped spray is not columnar or coherent.

European Patent Application 0,177,277 of Wilbanks, et al discloses a method of imparting a pattern onto fabric using jets of water that are emitted in "pulses." This process is much less efficient, time wise, than the method of the present invention.

The method disclosed in U.S. Pat. No. 5,737,813 to Sternlieb could be used to create a stripe pattern, but because the energy delivered by a single circular orifice is insufficient to provide adequate wash-out, the striping effect must be produced either with a series of orifices in multiple manifolds, or by making multiple passes through one machine.

It is not feasible to simply increase the number of orifices per inch in order to deliver more energy per pass. The material that comprises an orifice strip must be of sufficient thickness to withstand the liquid pressure behind it. This thickness is usually about ten time greater than the diameter of a typical circular orifice, e.g. an orifice strip having 0.303 inch diameter (or wide) orifices can be from about 0.010 up to 0.040 inch thick. If the orifice passage was a constant 0.003 inch diameter (or width) for the full 0.040 inch of its length, the resulting stream would become divergent, i.e. would not be coherent or columnar. In order to produce coherent or columnar jet that retains its effectiveness over greater distances, an orifice passage can be relieved at the exit end. This construction reduces the effective length of the orifice passage and results in a coherent or columnar jet. A negative side effect of this construction is to create a minimum distance between adjacent orifices, in order to retain adequate material in, and strength of, the orifice strip.

It is difficult to make and maintain multiple orifice/manifolds alignment so that successive impingements fall on the same wash-out line; with the result that the striping becomes blurred. Similarly, multiple pass striping operation requires precise repeatability of fabric tracking, and also an absence of shrinkage in the width direction of the fabric throughout the time required to make the required number of passes. If the tracking deviates or width shrinkage occurs, the striping becomes blurred.

The above references describe a variety of fabric support means. Fabric support is variously described as being flat or curved, smooth or textured, non-porous or foraminous; with certain combinations of the properties being used in any given application (e.g. a curved, smooth and foraminous roll; or a flat and textured conveyor "screen;" or a flat smooth and non-porous conveyor belt). Foraminous surfaces are described as being made of mesh screen material, or being a perforated sleeve. Another variable involves whether the fabric support is stationary, i.e. whether the fabric is "dragged" over the support (typically referred to as an "impact box"); or is moving with, or even effecting the transport of, the fabric.

In the fabric support configurations that involve a foraminous support, the references also disclose the use of a vacuum to enhance the hydroenhancement process. The vacuum keeps the water from pooling or flooding, and thereby impeding. the ability of the water jets to impinge the fabric. The vacuum can also facilitate the handling of the fabric by holding it tight to the support or support/transport member.

The above references also describe a variety of fabric transport means. Fabric transport can involve the use of a flat conveyor, or a serpentine path through a series of rolls. Additionally, the methods and apparatus of the prior art range from single-pass operations, using multiple manifolds and jet arrays; to multi-pass operations; to reciprocating operations where the fabric web travels first in one direction, then in the reverse direction, and possibly repeats this forward/reverse cycle numerous times in order to achieve a desired degree of hydroenhancement.

Further, the above references describe a variety of impingement angles, that is the angle at which a coherent jet strikes the surface of the fabric. In some cases the impingement is perpendicular to the fabric surface, but in other cases it is deliberately not.

The above references also describe methods of hydroenhancement where only one, or both sides of a fabric are subjected to the liquid jet impingement.

In the Detailed Description of the Preferred Embodiment of U.S. Pat. No. 6,253,429 to Zolin, at column 7, rows 9–12, is the statement that ". . . other diameter orifices and other orifice shapes can also be employed." However, nothing in the references shows or suggests an elongated orifice shape, or an orifice other than a circle.

SUMMARY OF THE PRESENT INVENTION

The present invention contemplates hydroenhancing fabrics with a liquid exiting a pressurized manifold through an array of elongated orifices. The liquid jet emanating from each elongated orifice is columnar or coherent in form, i.e. its cross section has minimum variation from where the liquid jet exits the orifice to where the liquid jet impinges the fabric. The benefits of using elongated orifices are several: to permit the presence of solid impurities in the pressurized liquid that would clog an array of circular orifices; to improve the energy efficiency of the hydroenhancement process; to reduce the number of passes required to create the desired hydroenhancement effect; to simplify the "striping" of fabrics, i.e. making a consistent pattern of alternating lighter and darker lines across the width of the fabric web with a single manifold and orifice strip; to permit hydroenhancing of high-warp-count fabrics without undesirable patterning; and to simplify the machinery that would be required to accomplish any given degree of hydroenhancement.

The range of methods and apparatus that can embody the present invention are as varied as the prior art. That is, fabric support can be flat or curved, smooth or textured, nonporous or foraminous; and fabric transport can likewise be provided in many varieties.

The distinguishing characteristic of the present invention over the prior art is the use of elongated orifices. One elongated orifice that is 0.003 inch wide and 0.030 inch long can deliver approximately ten times as much energy as a circular orifice of 0.003 inch diameter. This property permits the.development of hydroenhancing machines with fewer manifolds and orifice strips, resulting in less expensive equipment, and/or quicker processing times for the hydroenhancement of a fabric.

The method of hydroenhancing fabrics of the present invention comprises forcing liquid water under pressure out of a manifold through an orifice strip having a number of openings that are generally rectangular in shape. By using an orifice strip with elongated orifices, it is possible to achieve novel and reproducible striping effects at high production speeds.

The method according to the present invention can also be used to hydroenhance non-woven fabrics; provided the non-woven bats are in a cohesive condition or sate.

The present invention relates to a method for hydroenhancing fabrics using a shaped orifice that may be adapted and adjusted to optimize the hydroenhancement process, and further may be adapted to produce a variety of patterns in fabrics by varying the size, number and/or orientation of the shaped orifices. Specific features of the invention will be apparent from the above and from the following description of the illustrative embodiments. when considered with the attached drawings and the appended claims.

In summary, and in accordance with the above discussion, the foregoing objectives are achieved in the following embodiments.

1. A method for hydroenhancing a fabric comprising the steps of:
   (a) providing a support surface for the fabric;
   (b) providing a supply of pressurized liquid;
   (c) providing a manifold having a longitudinal axis and having at least one opening for the discharge of the pressurized liquid, where the opening has a length dimension that is at least one and a half times its width and the longitudinal axis of the opening is not parallel to the longitudinal axis of the manifold, where the pressurized liquid emerges from the opening as a jet;
   (d) directing the liquid jet toward the support surface;
   (e) interposing the fabric between the support surface and the manifold; and
   (f) inducing relative motion between the fabric and the manifold.
2. The method of hydroenhancing a fabric as described in paragraph 1 where the manifold has multiple openings for the discharge of the pressurized liquid.
3. The method of hydroenhancing a fabric as described in paragraph 2 where the direction of relative motion between the fabric and the manifold is perpendicular to the longitudinal axis of the manifold.
4. The method of hydroenhancing a fabric as described in paragraph 2 where the liquid jets are directed toward the support surface in a direction that is normal to the support surface.
5. The method of hydroenhancing a fabric as described in paragraph 2 where the liquid jets are directed toward the support surface at an angle that is at least 5 degrees from normal to the support surface.
6. The method of hydroenhancing a fabric as described in paragraph 2 where the support surface is flat.
7. The method of hydroenhancing a fabric as described in paragraph 2 where the support surface is curved.
8. The method of hydro enhancing a fabric as described in paragraph 1 where the longitudinal axis of the opening is perpendicular to the longitudinal axis of the manifold.
9. The method of hydroenhancing a fabric as described in paragraph 1 where the longitudinal axis of the opening is at a non-perpendicular angle to the longitudinal axis of the manifold.
10. The method of hydroenhancing a fabric as described in paragraph 2 where the longitudinal axes of the openings are parallel and the distances between adjacent openings are equal.
11. The method of hydroenhancing a fabric as described in paragraph 2 where the longitudinal axes of the openings are parallel and the distances between adjacent openings are varied.
12. The method of hydroenhancing a fabric as described in paragraph 1 where
    the opening has a liquid-entry face and a liquid-exit face and has side walls defined by elements connecting the liquid-entry and liquid-exit faces; and
    the elements of the side walls are parallel so that the liquid-entry face and liquid-exit face have substantially the same size and shape.
13. The method of hydroenhancing a fabric as described in paragraph 1 where the opening has a liquid-entry face and a liquid-exit face and has side walls defined by elements connecting the liquid-entry and liquid-exit faces; and the elements of the side walls are divergent running from the liquid-entry face toward the liquid-exit face so that the liquid-exit face is substantially larger than the liquid-entry face.

14. The method of hydroenhancing a fabric as described in paragraph 10 where the openings have a width from about two one-thousandths of an inch to about ten one-thousandths of an inch (0.002–0.010 inch) and a length of at least twice their width.

15. The method of hydroenhancing a fabric as described in paragraph 14 where the longitudinal axes of the openings are perpendicular to the longitudinal axis of the manifold.

16. The method of hydroenhancing a fabric as described in paragraph 14 where the longitudinal axes of the openings are not perpendicular to the longitudinal axis of the manifold.

17. The method of hydroenhancing a fabric as described in paragraph 10 where:

the openings have a width from about two one-thousandths of an inch to about ten one-thousandths of an inch (0.002–0.010 inch) and a length of at twice their width; and each of the openings has about the same width and length.

18. The method of hydroenhancing a fabric as described in paragraph 10 where:

the openings have a width from about two one-thousandths of an inch to about ten one-thousandths of an inch (0.002–0.010 inch) and a length of at least twice their width;

each of the openings is about the same width; and the openings have varying lengths.

19. The method of hydroenhancing a fabric as described in paragraph 11 where the openings have a width from about two one-thousandths of an inch to about ten one-thousandths of an inch (0.002–0.010 inch) and a length of at least twice their width.

20. The method of hydroenhancing a fabric as described in paragraph 19 where the longitudinal axes of the openings are perpendicular to the longitudinal axis of the manifold.

21. The method of hydroenhancing a fabric as described in paragraph 19 where the longitudinal axes of the openings are not perpendicular to the longitudinal axis of the manifold.

22. The method of hydroenhancing a fabric as described in paragraph 11 where:

the openings have a width from about two one-thousandths of an inch to about ten one-thousandths of an inch (0.002–0.010 inch) and a length of at least twice their width; and each of the openings has about the same width and length.

23. The method of hydroenhancing a fabric as described in paragraph 11 where:

the openings have a width from about two one-thousandths of an inch to about ten one-thousandths of an inch (0.002–0.010 inch) and a length of at least twice their width;

each of the openings has about the same width; and the openings have varying lengths.

24. The method of hydroenhancing a fabric as described in paragraph 2, where the support surface is foraminous.

25. The method of hydroenhancing a fabric as described in paragraph 24, where the support surface has a first side for supporting the fabric and a second side; and further comprising the step of providing a partial vacuum on the second side of the support surface.

26. The method of hydroenhancing a fabric as described in paragraph 2, where the fabric is moved past a stationary manifold.

27. Apparatus for hydroenhancing a fabric comprising:

a support surface for the fabric;

a supply of pressurized liquid;

a manifold having a longitudinal axis and having at least one orifice for the discharge of the pressurized liquid, where the orifice a) has a major axis that is at least one and a half times its minor axis b) and the major axis of the orifice is not parallel to the longitudinal axis of the manifold c) and the pressurized liquid emerges from the orifice as a jet directed toward the support surface; and means for inducing relative motion between the fabric and the manifold.

28. The apparatus for hydroenhancing a fabric as described in paragraph 27 where the manifold has multiple orifices for the discharge of pressurized liquid.

29. The apparatus for hydroenhancing a fabric as described in paragraph 28 where the direction of relative motion between the fabric and the manifold is perpendicular to the longitudinal axis of the manifold.

30. The apparatus for hydroenhancing a fabric as described in paragraph 28, where the fabric moves past a stationary manifold.

31. The apparatus for hydroenhancing a fabric as described in paragraph 30, where the support surface is curved.

32. The apparatus for hydroenhancing a fabric as described in paragraph 31, where the support surface is foraminous.

33. The apparatus for hydroenhancing a fabric as described in paragraph 32, where the support surface has a first side for supporting the fabric and a second side; and further comprising means for creating a partial vacuum on the second side of the support surface.

34. The method of hydroenhancing a fabric as described in paragraph 1 where the opening has a liquid-entry face and a liquid-exit face and has side walls defined by elements connecting the liquid-entry and liquid-exit faces; and the elements of the side walls are divergent running from the liquid-exit face toward the liquid-entrance face so that the liquid-entrance face is substantially larger than the liquid-exit face.

DESCRIPTION OF THE PREFERRED EMBODIMENTS OF THE PRESENT INVENTION

Figure 1:
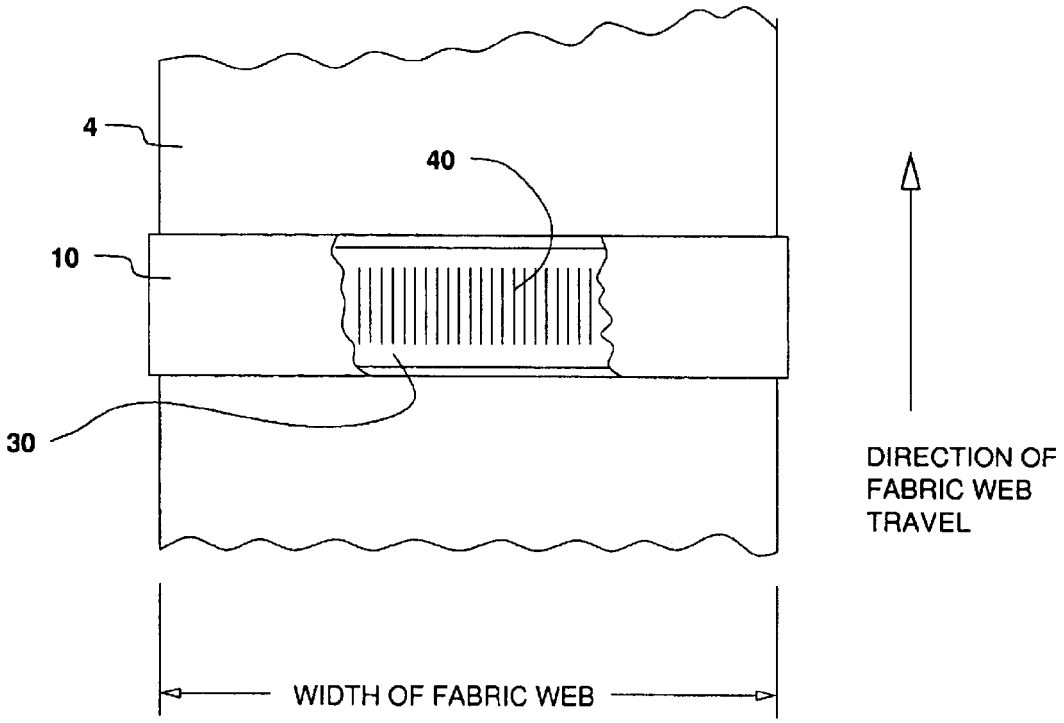
FIG. 1 is a plan view of a moving fabric web and a partially cut-away manifold.

FIG. 1 is a plan view of a moving web and a partially cut-away manifold.

In one embodiment of the present invention, a fabric web 4 passes underneath a manifold 10. Partially shown in the cut-away portion of manifold 10 is the orifice strip 30 and a series of parallel elongated orifices 40 in the orifice strip 30, where the major axes of the elongated orifices 40 are parallel with the direction of travel of fabric web 4. In FIG. 1, manifold 10 is placed so its longitudinal axis is perpendicular to the direction of travel of fabric web 4, and fabric web 4 appears to be on a flat support surface (not shown). However, it is within the practice of the present invention to orient manifold 10 so that its longitudinal axis is not perpendicular to the direction of travel of fabric web 4.

Figure 2:
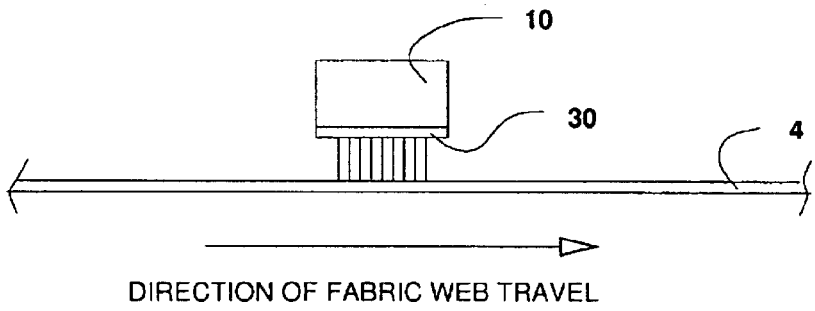
FIG. 2 is a side elevation view of a moving fabric web, a manifold and an orifice strip.

FIG. 2 is a side elevation view of a moving web, a manifold and an orifice strip.

In one embodiment of the present invention, moving fabric web 4 passes underneath manifold 10 and orifice strip 30. Liquid under pressure is contained in manifold 10, and exits through orifices in the orifice strip 30. In the view of FIG. 2, the direction of impingement of the columnar jet of liquid is normal, or perpendicular to the surface of the fabric. However, it is contemplated that the present invention can also be practiced where the angle of impingement is non-normal to the fabric surface. Further, FIG. 2 shows the fabric web in a flat orientation. But, the present invention can also be practiced with the fabric web being in a curved configuration.

Figure 3:
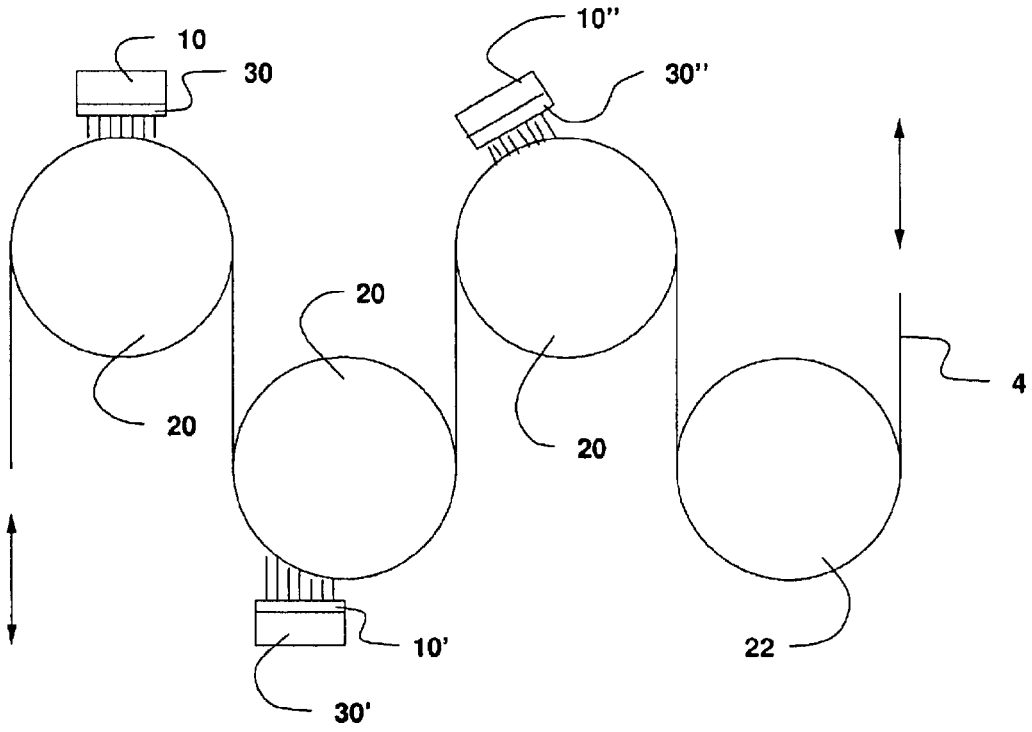
FIG. 3 is an elevation view of a fabric web in a serpentine path showing circular fabric supports and manifolds in two different positions.

FIG. 3 is an elevation view of a fabric web in a serpentine path showing circular fabric supports and manifolds in three different positions.

Moving fabric web 4 can be threaded through a series of rolls 20, 22 with manifolds 10, 10', 10" arranged so as to direct liquid jets toward the web. In FIG. 3, rolls 20 are called support rolls because they are associated with a manifold (10, 10', 10"). Roll 22 is not a support roll, but could be either an idler roll or a drive roll. Support rolls 20 can be either smooth or textured, or can be porous or non-porous, and can be produced in a variety of diameters to effect differing amounts of curvature to.the moving fabric web 4.

Manifold 10 and orifice strip 30 are arranged so that the columnar jets of liquid impinge the moving fabric web 4 in a near-normal direction. Alternate arrangements are shown by the placement of manifolds 10' and 10" and orifice strips 30' and 30" so that the columnar jets of liquid impinge the moving fabric web 4 in a non-normal direction. The amount of "offset" can be varied, either by displacing a manifold laterally as is shown by manifold 10', or by rotating a manifold about its longitudinal axis as shown by manifold 10".

Figure 4:
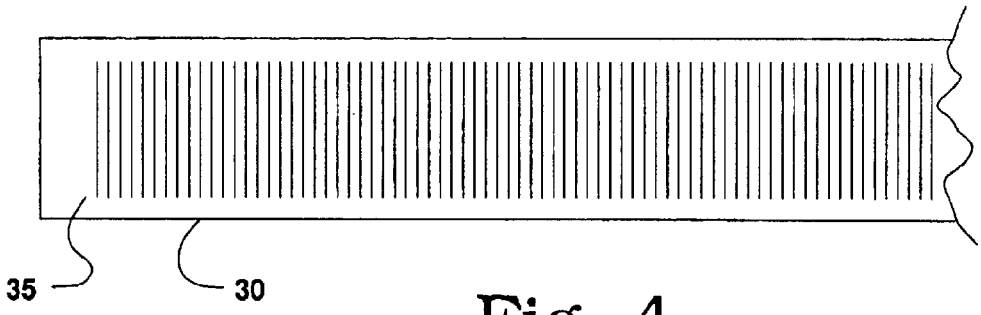
FIG. 4 is a depiction of an orifice strip having equally-spaced, parallel, similar length elongated orifices.

FIG. 4 is a depiction of an orifice strip having equally-spaced, parallel, similar length elongated orifices.

One possible arrangement of elongated orifices in orifice strip 30 is shown in FIG. 4. Orifice strip 30 has two faces, face 35 being the face where the liquid under pressure will emerge. The major axes of the elongated orifices according to this embodiment will be perpendicular to the longitudinal axis of the manifold (not shown).

Figure 6:
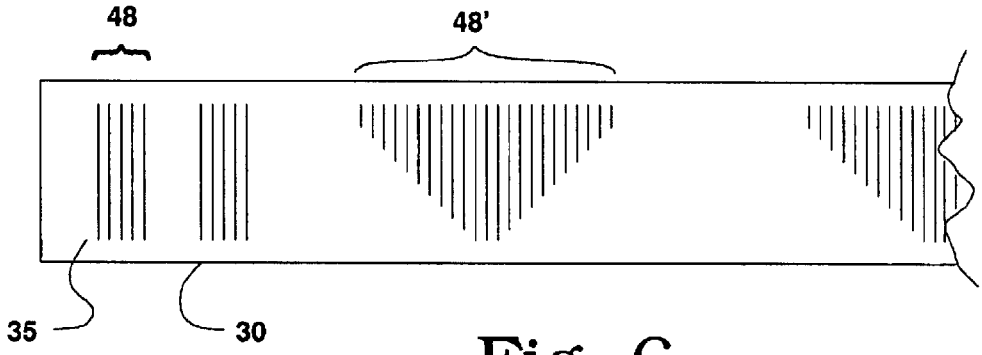
FIG. 6 is a depiction of an orifice strip having variably spaced, parallel, variable length elongated orifices.

An arrangement where the major axes of the elongated orifices are parallel to the direction of fabric web travel is the preferred mode for striping operations, and for most fabric hydroenhancement operations when practicing the present invention. FIG. 6, below, also shows an arrangement of elongated orifices where (with the manifold longitudinal axis perpendicular to the fabric travel direction) the major axes of the elongated orifices are parallel to the direction of fabric web travel.

Figure 5:
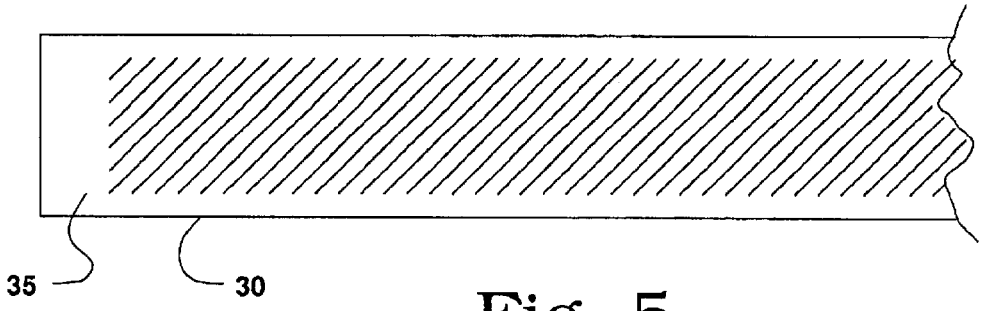
FIG. 5 is a depiction of another orifice strip having equally-spaced, parallel, similar length elongated. orifices.

FIG. 5 is a depiction of another orifice strip having equally-spaced, parallel, similar length elongated orifices.

In the orifice strip 30 of FIG. 5, the major axes of the elongated orifices will be at an oblique (non-perpendicular) angle to the longitudinal axis of the manifold (not shown). Various angles of inclination can be practiced using the principles of the present invention, but a practical maximum deviation from perpendicular to the manifold longitudinal axis is about 60 degrees.

FIG. 6 is a depiction of a orifice strip having variably spaced, parallel, variable length elongated orifices.

In a striping operation, the amount of wash-out varies depending on the amount of energy delivered to the fabric. Elongated orifices of greater length will provide more wash-out than orifices having shorter length. The color of the stripe can be varied by changing the length of the elongated orifice, i.e. a longer orifice will produce greater color wash-out.

By varying the length of the orifices in a pattern as illustrated in FIG. 6, varying amounts of wash-out occur over the width of the fabric web. Note that the elongated orifices in orifice strip 30 of FIG. 6 are arranged so that there are also varying spaces between adjacent orifices. Where there are no orifices, the fabric is not washed-out, resulting in a more pronounced striping effect. The width of the stripes can be varied by repeating orifice "clusters" 48, comprising a certain pattern of orifices, where adjacent orifice clusters 48 are separated by areas having no orifices.

The sharpness of the stripe pattern can be varied as well. In the orifice strip 30 of FIG. 6, orifice cluster 48 is made of individual elongated orifices having the same length. This produces a sharper contrast between washed-out and non-washed-out regions of fabric. But, the elongated orifices of orifice cluster 48' have varying lengths. The effect of this is to produce a greater range of wash-out amount. Many different patterns of striping can be produced by varying the number of elongated orifices in an orifice cluster, and by varying (or not) the length of individual elongated orifices within an orifice cluster.

An orifice strip of an embodiment shown in FIG. 6 has been shown to produce a seer-sucker effect. This effect was produced on a light-weight 3.5 ounce sheeting fabric, using elongated orifices about 0.003 inch wide and 0.012 in long. The pattern of orifices was three elongated orifices at a pitch 35 per inch then a space equal to three orifices, then three orifices, then a space, etc.

Figure 7:
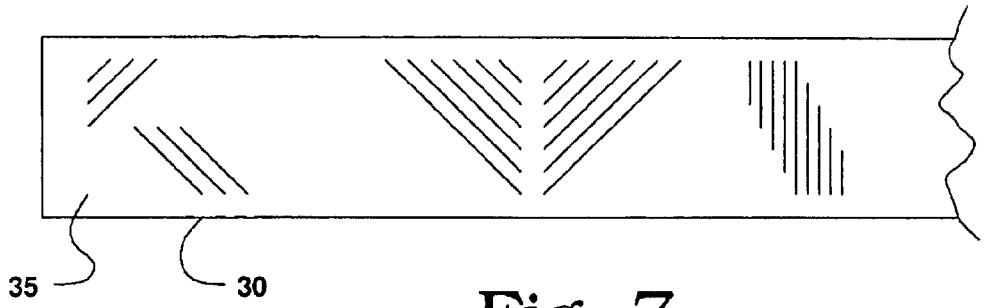
FIG. 7 is a depiction of an orifice strip having yet another arrangement of elongated orifices.

FIG. 7 is a depiction of a orifice strip having yet other possible arrangements of elongated.orifices.

The orifice clusters shown in FIG. 7 depict a variety of orifice cluster designs that can be practiced within the present invention. Note that various combinations of length, angle and position are shown, and each of these variables may be used to control the hydroenhancement effect.

Figure 8:
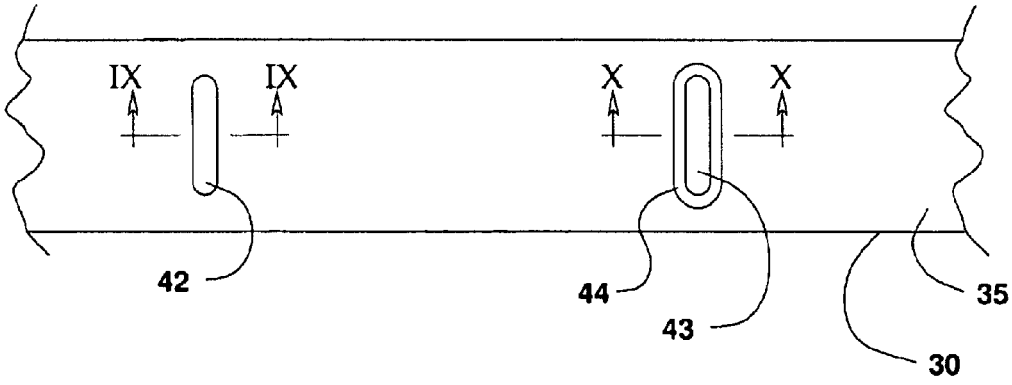
FIG. 8 is a depiction of an orifice strip showing two elongated orifices.

FIG. 8 is a depiction of an orifice strip showing two elongated orifices.

Orifices 42 and 43 are shown from the liquid exit face 35 of orifice strip 30. Orifice 42 has a constant cross section throughout the thickness of orifice strip 30, while orifice 43 has a varying cross section, made up of a through hole and relief 44.

Figure 9:
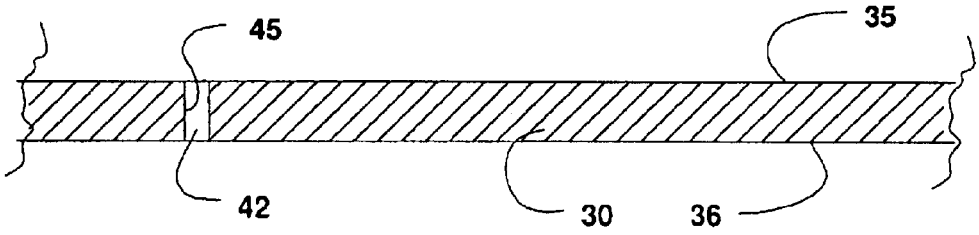
FIG. 9 is a cross-sectional view taken on line IX—IX of FIG. 8.

FIG. 9 is a cross-sectional view taken on line IX—IX of FIG. 8.

Elongated orifice 42 in orifice strip 30 has a constant cross section throughout the thickness of the orifice strip. Orifice 42 is defined by orifice walls 45. Walls 45 are a source of friction to the moving liquid as it passes through the orifice 42. As the liquid emerges from orifice 42 at liquid-exit (or down-stream or low pressure) side 35, the friction is relieved, resulting in the production of a divergent stream of liquid, where the cross section of the stream or jet increases after being emitted from the orifice strip 30.

Figure 10:
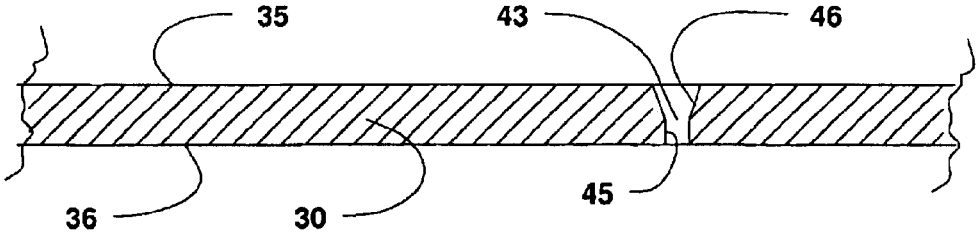
FIG. 10 is a cross-sectional view taken on line X—X of FIG. 8.

FIG. 10 is a cross-sectional view taken on line X—X of FIG. 8.

Elongated orifice in orifice strip 30 can be described as beginning at liquid-entry (or up-stream, or high pressure) side 36, and progressing toward liquid-exit side 35. The length of constant cross section defined by walls 45 is less than the thickness of the orifice strip. A relief 44 having angled walls 46 is provided to reduce friction between the rapidly moving liquid and the side walls of the elongated orifice. The result of providing a relief 44 with angled walls 46 is the production of a columnar stream of liquid, where the cross section of the stream or jet increases very gradually after being emitted from the orifice strip 30.

The method of the present invention can be practiced either with elongated orifices similar to orifice 42 of FIGS. 8 and 9, or with relieved elongated orifices similar to orifice 43 and relief 44 as shown in FIGS. 8 and 10. The preferred embodiment uses relieved elongated orifices.

As shown in FIGS. 8 and 10, and as discussed above, the reliefs 44 are on the low pressure, or liquid exit face of the orifice strip. However, it is possible to practice the method of the present invention using a relieved orifice where the relief appear on the high pressure or liquid-entrance face of the orifice strip.

EXPERIMENTAL RESULTS

A test was run using various orifice strips. For all tests: the liquid used was water; the pressure was about 1750 PSIG; and the fabric support surface was a 100 mesh screen having a curved shape. For each test, a woven 4.7 ounce polyester fabric (44×30/12–10, having a permeability of 1,350 standard cubic feet of air per minute) was subjected to 6 passes at a web velocity of 100 feet per minute, treating alternate sides of the fabric at each pass, i.e. each side of the fabric was treated 3 times.

Orifice Strip A
circular orifices 0.003 inch in diameter and spaced 102 orifices per inch.
Orifice Strip B
circular orifices 0.005 inch in diameter and spaced 60 orifices per inch.
Orifice Strip C
circular orifices 0.007 inch in diameter and spaced 30 orifices per inch.
Orifice Strip D (Present Invention)
elongated orifices 0.003 inch wide by 0.009 inch long, with the spacing between the orifice major axes being 0.029 inches (pitch of 35 per inch) and arranged with the major axes of the orifices parallel to the fabric travel direction and perpendicular to the longitudinal axis of the manifold (elongated orifice arrangement as depicted in FIG. 4 ).

The chart below summarizes the test parameters. The first column indicates the test subject, the second column indicates the size (in inches) and shape of the test orifices, the third column indicates the area of a single orifice (in square inches) of that size-and shape, the fourth column indicates the "pitch," or number of orifices per inch of length of the jet strip, the fifth column indicates the combined area of the orifices in one inch of test strip (e.g. 102 orifices of 0.003 inch diameter have a combined area of 0.007 square inches), and the sixth column indicates the permeability of the test fabric after the fabric had been hydroenhanced. Air permeability is the number of standard cubic feet of air per minute at a test pressure that will pass through a given area of test fabric. Lower permeability values indicate a greater degree of hydroenhancement.

| Test | Orifice Size | Area per Orifice | Orifice Pitch | Area per inch | Air Perm |
|---|---|---|---|---|---|
| A | .003 dia | .000 007 | 102/inch | .0007 | 702 |
| B | .005 dia | .000 020 | 60/inch | .0012 | 765 |
| C | .007 dia | .000 038 | 30/inch | .0012 | 660 |
| D | .003 × .009 | .000 027 | 35/inch | .0009 | 618 |

The present invention, described above, relates to a method for hydroenhancing fabrics using a shaped orifice. Features of the present invention are recited in the appended claims. The drawings contained herein necessarily depict structural features and embodiments of the method for hydroenhancing fabrics using a shaped orifice, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What we claim is:

1. Apparatus for hydroenhancing a fabric comprising:

a support surface for the fabric;

a supply of pressurized liquid;

a manifold having a longitudinal axis and having at least one orifice for the discharge of the pressurized liquid, where the orifice a) has a major axis that is at least one and a half times its minor axis b) and the major axis of the orifice is not parallel to the longitudinal axis of the manifold c) and the pressurized liquid emerges from the orifice as a jet directed toward the support surface; and means for inducing relative motion between the fabric and the manifold.

2. The apparatus for hydroenhancing a fabric as described in claim 1 where the manifold has multiple orifices for the discharge of the pressurized liquid.

3. The apparatus for hydroenhancing a fabric as described in claim 2 where the longitudinal axes of the orifices are perpendicular to the longitudinal axis of the manifold.

4. The apparatus for hydroenhancing a fabric as described in claim 2 where the longitudinal axes of the orifices are at a non-perpendicular angle to the longitudinal axis of the manifold.

5. The apparatus for hydroenhancing a fabric as described in claim 2 where the longitudinal axes of the orifices are parallel and the distances between adjacent orifices are equal.

6. The apparatus for hydroenhancing a fabric as described in claim 2 where the longitudinal axes of the orifices are parallel and the distances between adjacent orifices are varied.

7. The apparatus for hydroenhancing a fabric as described in claim 2 where the direction of relative motion between the fabric and the manifold is perpendicular to the longitudinal axis of the manifold.

8. The apparatus for hydroenhancing a fabric as described in claim 2 where the liquid jets are directed. toward the support surface in a direction that is normal to the support surface.

9. The apparatus for hydroenhancing a fabric as described in claim 2 where the liquid jets are directed toward the support surface at an angle that is at least 5 degrees from normal to the support surface.

10. The apparatus for hydroenhancing a fabric as described in claim 2, where the fabric moves past a stationary manifold.

11. The apparatus for hydroenhancing a fabric as described in claim 10 where the support surface is flat.

12. The apparatus for hydroenhancing a fabric as described in claim 10 where the support surface is curved.

13. The apparatus for hydroenhancing a fabric as described in claim 10, where the support surface is foraminous.

14. The apparatus for hydroenhancing a fabric as described in claim 13, where the support surface has a first side for supporting the fabric and a second side; and further comprising means for creating a partial vacuum on the second side of the support surface.

15. The apparatus for hydroenhancing a fabric as described in claim 1 where the orifice has a liquid-entry face and a liquid-exit face and has side walls defined by elements connecting the liquid-entry and liquid-exit faces; and the elements of the side walls are parallel so that the liquid-entry face and liquid-exit face have substantially the same size and shape.

16. The apparatus for hydroenhancing a fabric as described in claim 1 where the orifice has a liquid-entry face and a liquid-exit face and has side walls defined by elements connecting the liquid-entry and liquid-exit faces; and the elements of the side walls are divergent running from the liquid-entry face toward the liquid-exit face so that the liquid-exit face is substantially larger than the liquid-entry face.

17. The apparatus for hydroenhancing a fabric as described in claim 5 where the orifices have a width from about two one-thousandths of an inch to about ten one-thousandths of an inch (0.002–0.010 inch) and a length of at least twice their width.

18. The apparatus for hydroenhancing a fabric as described in claim 17 where the longitudinal axes of the orifices are perpendicular to the longitudinal axis of the manifold.

19. The apparatus for hydroenhancing a fabric as described in claim 5 where:

the orifices have a width from about two one-thousandths of an inch to about ten one-thousandths of an inch (0.002–0.010 inch) and a length of at least twice their width; and each of the orifices has about the same width and length.

20. The apparatus for hydroenhancing a fabric as described in claim 5 where:

the orifices have a width from about two one-thousandths of an inch to about ten one-thousandths of an inch (0.002–0.010 inch) and a length of at least twice their width;

each of the orifices is about the same width; and the orifices have varying lengths.

* * * * *